US010393367B2

(12) United States Patent
Fisher

(10) Patent No.: US 10,393,367 B2
(45) Date of Patent: Aug. 27, 2019

(54) MULTI-ANGLE SLUDGE LANCE

(71) Applicant: BWXT Nuclear Energy, Inc., Lynchburg, VA (US)

(72) Inventor: Benjamin D. Fisher, Lynchburg, VA (US)

(73) Assignee: BWXT Nuclear Energy, Inc., Lynchburg, VA (US)

( * ) Notice: Subject to any disclaimer, the term of this patent is extended or adjusted under 35 U.S.C. 154(b) by 0 days.

(21) Appl. No.: 15/699,294

(22) Filed: Sep. 8, 2017

(65) Prior Publication Data

US 2019/0078774 A1 Mar. 14, 2019

(51) Int. Cl.

| | |
|---|---|
| ***F22B 37/48*** | (2006.01) |
| ***F22B 37/54*** | (2006.01) |
| ***F28G 3/16*** | (2006.01) |

(52) U.S. Cl.

CPC ..... *F22B 37/54* (2013.01); *F28G 3/166* (2013.01)

(58) Field of Classification Search

CPC ..... A47L 15/18; A47L 15/4282; F22B 37/48; F22B 37/486; F22B 37/483; F22B 37/54; F28G 1/16; F28G 1/166

See application file for complete search history.

(56) References Cited

U.S. PATENT DOCUMENTS

| | | | | |
|---|---|---|---|---|
| 4,407,236 | A * | 10/1983 | Schukei | F22B 37/483 122/382 |
| 4,572,284 | A | 2/1986 | Katscher et al. | |
| 5,065,703 | A * | 11/1991 | Lee | F22B 37/483 122/379 |
| 5,509,609 | A * | 4/1996 | Kamler | B08B 9/0321 122/392 |

(Continued)

FOREIGN PATENT DOCUMENTS

| | | |
|---|---|---|
| CA | 2262335 | 1/2000 |
| EP | 0766040 A1 | 4/1997 |
| WO | 2008/005870 A2 | 1/2008 |

OTHER PUBLICATIONS

Extended European Search Report, European Application No. 18191434.2, dated Jan. 24, 2019, 7 pages.

*Primary Examiner* — Gregory A Wilson

(74) *Attorney, Agent, or Firm* — Nelson Mullins Riley & Scarborough LLP

(57) ABSTRACT

A sludge lancing system for use in a steam generator including a no tube lane disposed between a first bank of tubes and a second bank of tubes that are transverse to a horizontal reference plane, having a rail that extends through the no tube lane and includes a longitudinal center axis that lies in a first plane that is parallel to the reference plane, and a first lancing head, having a body portion a conduit, a nozzle assembly that is mounted to the body portion and is pivotable with respect to the body portion about an axis of (Continued)

rotation, the nozzle assembly including a manifold defining a conduit that is in fluid communication with the conduit of the body portion, at least a first nozzle that is mounted to the manifold and defines a conduit that generates a lancing fluid jet, wherein the conduit of the first nozzle lies in a first plane that is transverse to the longitudinal center axis of the rail so that the lancing fluid jet of the first nozzle is disposed in the first plane when the manifold is pivoted about the axis of rotation.

16 Claims, 17 Drawing Sheets

(56) References Cited

U.S. PATENT DOCUMENTS

| | | | | |
|---|---|---|---|---|
| 5,514,219 | A * | 5/1996 | Kamler | B08B 3/024 122/392 |
| 5,555,851 | A | 9/1996 | Vandenberg | |
| 5,570,660 | A | 11/1996 | Vandenberg | |
| 5,572,957 | A | 11/1996 | Vandenberg | |
| 5,782,209 | A | 7/1998 | Vandenberg | |
| 8,238,510 | B2 * | 8/2012 | Haberman | F22B 37/486 376/316 |
| 8,646,416 | B2 * | 2/2014 | Hawkins | F22B 37/003 122/379 |
| 8,800,500 | B2 | 8/2014 | Hawkins et al. | |
| 9,920,925 | B2 * | 3/2018 | Hawkins | F22B 37/483 |
| 10,012,381 | B2 * | 7/2018 | Haberman | F22B 37/486 |
| 2015/0027499 | A1 | 1/2015 | Fischer et al. | |

* cited by examiner

MULTI-ANGLE SLUDGE LANCE

FIELD OF THE INVENTION

The present invention relates generally to devices for maintaining heat exchangers and their use. More particularly, the present invention relates to a sludge lance for use in the removal of sludge from the shell side of a shell-and-tube type steam generator.

BACKGROUND OF THE INVENTION

Sludge lancing operations are used in the commercial power industry to remove accumulations and deposits of debris and other matter, referred to as sludge, from between individual tubes in an arrangement of a group of tubes, i.e., a tube sheet bundle, in various power plant components, such as steam generators and heat exchangers of the shell-and-tube variety. The accumulation of sludge in between individual tubes in tube sheet bundles may result in reduced efficiencies of power plant components. Sludge accumulation can also result in mechanical impingement or damage to tubes and chemical degradation or corrosion of tube walls in such components. Failure of one or multiple tubes can result in a power plant being taken out of service to repair or replace damaged tubes.

Typically, sludge lancing is performed during a power plant outage or when particular equipment (e.g., a steam generator) is placed out of service. Sludge lancing involves directing a high pressure stream of water through a tube sheet bundle to remove accumulated sludge from between individual tubes.

In a conventional system, a nozzle is mounted or secured to a pipe or other structure to provide stability and to allow the nozzle to translate along a horizontal axis. The nozzle can translate along a vertical axis by raising or lowering the pipe on which the nozzle is mounted. Aligning the nozzle prior to initiating the lancing operation is typically attempted by spraying a stream of water through a tube sheet bundle and visually observing the steam of water as it exits the bundle. Once the nozzle is aligned, there is no disruption to the water stream itself. Aligning the nozzle is an iterative and time consuming process that involves spraying water through the nozzle, visually observing the stream of water as it travels through the tube sheet bundle, and manipulating the position of the nozzle until the stream of water exits the tube sheet bundle without disruption of the stream of water. As well, because the nozzles are typically oriented so that their spray patterns are in a horizontal plane, numerous passes are typically made with the vertical position of the nozzle changed on each pass.

Because current methods rely on visual alignment of the nozzle, as described above, lancing sludge from between tubes (i.e., sludge lancing) is generally performed with the nozzle positioned 90° with respect to the tube sheet bundle, i.e., "head-on" to tube sheet bundle. However, it is often desirable to direct the stream of water from the nozzles at angles other than 90° in order to remove additional sludge that cannot be reached at 90°.

The present invention recognizes and addresses the foregoing considerations, and others, of prior art constructions and methods.

SUMMARY OF THE INVENTION

One embodiment of the present disclosure provides a sludge lancing system for use in a steam generator including a no tube lane disposed between a first bank of tubes and a second bank of tubes that are transverse to a horizontal reference plane, the system including a rail that extends through the no tube lane and includes a longitudinal center axis that is parallel to the reference plane, and a first lancing head. The first lancing head includes a body defining a conduit, a nozzle assembly that is mounted to the body and is pivotable with respect to the body about an axis of rotation, the nozzle assembly including a manifold defining a conduit that is in fluid communication with the conduit of the body, and at least a first nozzle that is mounted to the manifold and defines a conduit that generates a lancing fluid jet, wherein a longitudinal center axis of the conduit of the first nozzle lies in a first plane that is transverse to the longitudinal center axis of the rail so that the lancing fluid jet of the first nozzle is disposed in the first plane when the manifold is pivoted about the axis of rotation.

Another embodiment of the present disclosure provides a sludge lancing system for use in a steam generator including a no tube lane disposed between a first bank of tubes and a second bank of tubes that are transverse to a horizontal reference plane, the system including a rail that extends through the no tube lane and includes a longitudinal center axis that is parallel to the reference plane, and a first lancing head. The first landing head includes a body having a manifold defining a conduit, and a nozzle assembly that is mounted to the manifold of the body, the nozzle assembly including a first nozzle housing that is mounted to the manifold and defines a bore that is in fluid communication with the conduit of the manifold, a first nozzle that is mounted to the first nozzle housing and defines a conduit that generates a lancing fluid jet, a second nozzle housing that is mounted to the manifold and defines a bore that is in fluid communication with the conduit of the manifold, and a second nozzle that is mounted to the second nozzle housing and defines a conduit that generates a lancing fluid jet. A longitudinal center axis of the conduit of the first nozzle lies in a first vertical plane that is transverse to both the horizontal reference plane and a first horizontal plane that is parallel to the horizontal reference plane and contains a longitudinal center axis of the conduit of the manifold, and the longitudinal center axis of the conduit of the first nozzle and an intersection line of the first vertical plane and the first horizontal plane define a first acute angle therebetween. A longitudinal center axis of the conduit of the second nozzle lies in a second vertical plane that is transverse to both the horizontal reference plane and the first horizontal plane that is parallel to the horizontal reference plane and contains a longitudinal center axis of the conduit of the manifold, and the longitudinal center axis of the conduit of the second nozzle and an intersection line of the second vertical plane and the first horizontal plane define a second acute angle therebetween, and the first acute angle is larger than the second acute angle.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof to one of ordinary skill in the art, is set forth more particularly in the remainder of the specification, which makes reference to the accompanying figures, in which.

Figure 1:
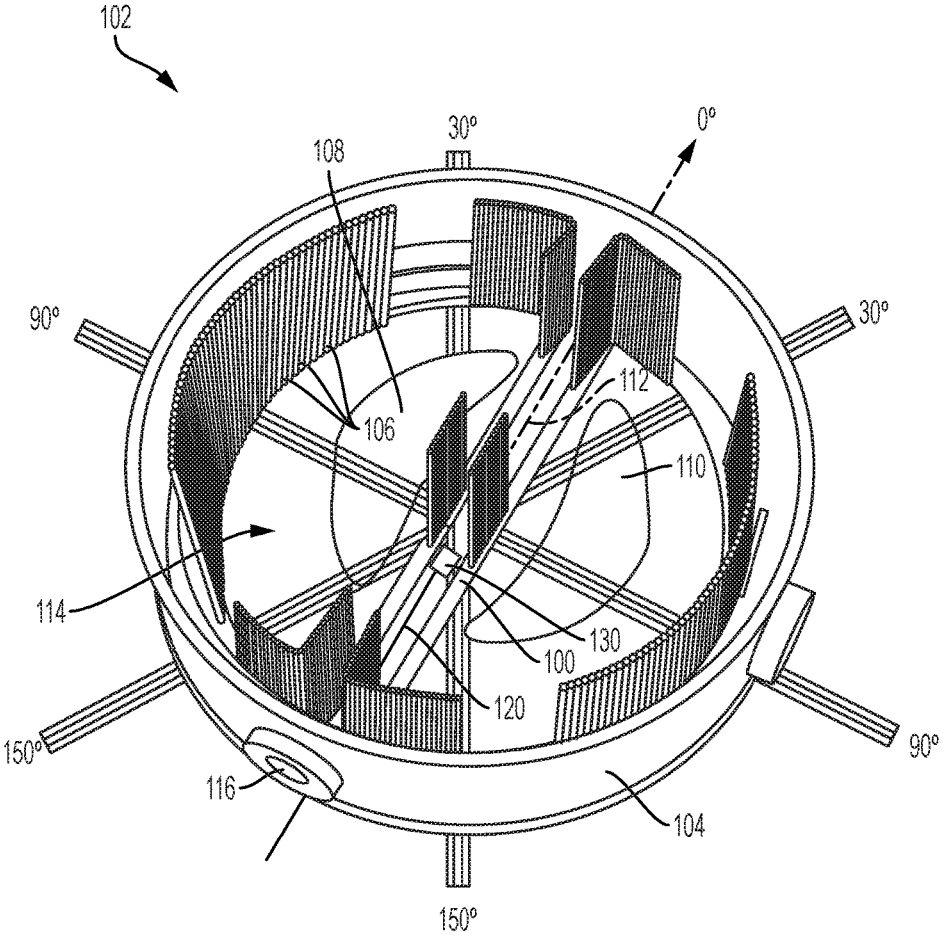
FIG. 1 diagrammatically shows a perspective sectional view of an embodiment of a sludge lancing system in accordance with the present disclosure performing sludge lancing on a steam generator.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
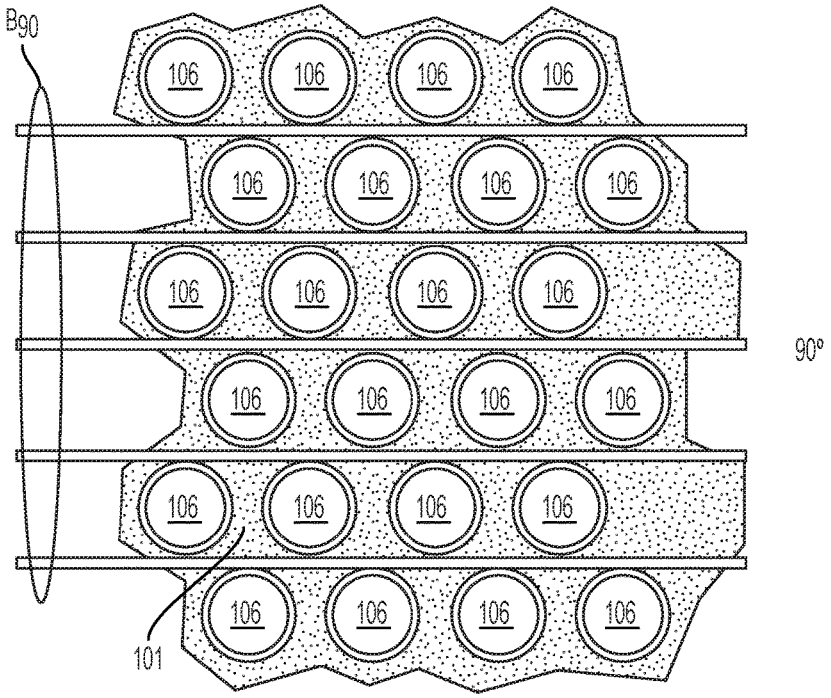
FIG. 2 diagrammatically shows sludge lancing suitably performed by the sludge lancing system shown in FIG. 1 along tube lanes at 90° respective to the no tube lane.

As used herein, terms referring to a direction or a position relative to the orientation of the water heater, such as but not limited to "vertical," "horizontal," "upper," "lower," "above," or "below," refer to directions and relative positions with respect to the heat exchanger's orientation in its normal intended operation, as indicated in FIGS. 1 and 2 herein. Thus, for instance, the terms "vertical" and "upper" refer to the vertical direction and relative upper position in the views of FIGS. 1 and 2 and should be understood in that context, even with respect to a heat exchanger that may be disposed in a different orientation.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment" as used herein does not necessarily refer to the same embodiment, although it may.

With reference to FIG. 1, a sludge lancing system 100 is illustrated in the context of a typical steam generator 102 which is constructed similarly to that described in U.S. Pat. No. 6,498,827, which is assigned to Babcock & Wilcox Canada Ltd., and incorporated by its entirety herein by reference. As shown in the partial cut-away view of FIG. 1, steam generator 102 includes a vessel 104 through which tubes 106 pass so as to allow heat transfer between fluid contained in vessel 104 and fluid flowing in tubes 106. Depending upon the steam generator design, heated water, steam, or steam/water mixture (possibly superheated, sub-cooled or in another thermodynamic state) flows in tubes 106 and feed water is fed into vessel 104 and converted to steam (an arrangement known as shell-side boiling since the feedwater that boils is outside the tubes); or vice versa (tube-side boiling). In a typical steam generator used in conjunction with a nuclear reactor of the pressurized water reactor variety, coolant in the nuclear reactor (called "primary" coolant) is heated by the nuclear reactor core to an elevated temperature and pressure (e.g. a sub-cooled or other thermodynamic state), and is piped from the nuclear reactor to the steam generator 102 where the primary coolant flows through tubes 106. Secondary coolant flows outside the tubes and boils shell-side. Vessel 104 is a pressure vessel which contains the pressurized steam (that is, boiled secondary coolant), which is piped out of the steam generator to drive a turbine that in turn drives an electrical generator (in a nuclear power plant), or the secondary coolant steam may be used to perform other useful work. FIG. 1 diagrammatically illustrates a sectional perspective view of steam generator 102 including portions of vessel 104 and tubes 106. The tube configuration may vary, e.g., once-through steam generator (OTSG) tubing (optionally employing a counter-flow design in which primary coolant flows downward through tubes 106 and secondary coolant flows generally upward in vessel 104), U-shaped steam generator tubing, or so forth. The steam generator may also include various other components that are not illustrated in the partial sectional view of FIG. 1, such as (by way of non-limiting illustrative example) steam separator or dryer units, flow control features, etc.

The arrangement of tubes 106 in vessel 104 is designed to facilitate both operation and maintenance. In general, it is desirable to have a high packing density of tubes to provide a large total heat transfer surface area, but provision is also made to provide access to tubes for maintenance. In the illustrative steam generator 102, tubes 106 are segregated (as viewed in a cross-sectional plane transverse to the tubes) into two hemispherical tube sections 108 and 110 separated by a "no tube lane" 112 which provides the maintenance access. Tubes 106 are typically straight and mutually parallel (although some tube bends are contemplated to accommodate components or so forth, and other variants may exist such as an upper "U"-shaped turn in the case of "U"-shaped tubing or so forth), and so this arrangement defines an "instance" of the no tube lane 112 at each planar tubesheet or other horizontal plate or surface intersecting tubes 106. Without loss of generality, a "floor" 114 is denoted in FIG. 1, where it is to be understood that the floor 114 may be any upper surface oriented transverse to tubes 106. For example, floor 114 may be the upper surface of a lower tubesheet providing fluid communication to the bottom ends of tubes 106, or the upper surface of a middle, upper, or other-elevation tubesheet. A vessel port, vessel penetration, or manway 116 can be opened (after depressurization and draining of vessel 104, as in during a maintenance shutdown) to provide access to the space above floor 114. Preferably, manway 116 is aligned with no tube lane 112 so that a first lancing head 130 (FIGS. 8 through 12) and/or a second lancing head 230 (FIGS. 13 through 16) can be inserted and moved along no tube lane 112 to perform lancing of tubes 106. First and second lancing heads 130 and 230 are moved along a rail 120 that is inserted into vessel 104 through manway 116 so that it extends along no tube lane 112. Floor 114 corresponds to a reference plane that includes no tube lane 112 and is transverse to tubes 106.

Referring additionally to FIG. 1, within each tube section 108, 110 of the present embodiment, tubes 106 are arranged in a honeycomb or hexagonally symmetric pattern. Without loss of generality, the direction of no tube lane 112 is designated as reference 0°, as shown in FIG. 1. The honeycomb or hexagonal layout of tubes 106 then defines a set of parallel tube lanes in the reference plane defined by floor 114 at 30° respective to the 0° reference angle of no tube lane 112, a set of parallel tube lanes in the reference plane defined by floor 114 at 90° respective to the 0° reference angle of no tube lane 112, and a set of parallel tube lanes in the reference plane defined by floor 114 at 150° respective to the 0° reference angle of no tube lane 112. Each tube lane is a path (lane) in the reference plane defined by floor 114 that does not intersect any of tubes 106. The tube lanes are lines when referenced to the two-dimensional geometry (reference plane) of floor 114. When referenced to three-dimensional space of steam generator 102, the sets of tube lanes at 30°, 90°, and 150° are sets of planes that are transverse to floor 114 and oriented at angles of 30°, 90° and 150° respective to a "0° plane" that is transverse to floor 114 and contains no tube lane 112.

It is to be appreciated that the geometry of steam generator 102 shown in FIGS. 1 through 4 is illustrative, and other geometries are contemplated. For example, alternate embodiments of the disclosed sludge lancing system 100 may be used for lancing operations in steam generators having tube geometries such as, but not limited to, triangular, square, rotated square, rotated triangular, and rectangular. In such other geometries, it may be advantageous to define a no tube lane (or possibly two or more no tube lanes, for example oriented at 90° to each other) to provide access for maintenance, and to arrange the tubes on either side of the no tube lane in a pattern that defines tube lanes. As well, for lancing operations of steam generators having various tube geometries, lancing heads can be provided in which the nozzles are angled accordingly with regard to the no tube lane along which the corresponding lancing head travels. The illustrative honeycomb or hexagonal pattern is advantageously a close packed lattice.

The sludge lancing system and techniques are described herein in conjunction with the maintenance of a steam generator for a nuclear reactor. However, this is merely an illustrative example, and it will be appreciated that the disclosed sludge lancing system and techniques may more generally be employed in the maintenance of other types of steam generators which may for example be used in conjunction with a fossil fuel boiler or the like.

The primary and secondary coolants typically comprise purified water, either one or both of which may contain additives. For example, the primary coolant of a nuclear reactor may contain a soluble boron additive acting as a neutron poison to control the nuclear chain reaction. Furthermore, although purified, the primary and secondary coolant may include some contaminants. The secondary coolant does not contact the nuclear reactor core and (absent any tube leakage in the steam generator) should be free of radioactive contaminants. The secondary coolant may have a lower purification level as compared with the primary coolant. Contaminants and/or additives in the secondary coolant (or other coolant flowing shell-side or in vessel 104) may generate buildup of deposits over time, which are commonly called "sludge". This sludge tends to accumulate at or near certain elevations in vessel 104, such as at the upper surface of a tubesheet. Sludge may collect on (or precipitate out onto, or react with, or so forth) the outsides of tubes 106 and/or on the tubesheets or other structures. Sludge buildup can produce various problems. For example, sludge comprising chemical formation of deposits can initiate stress corrosion cracking in the tubes or other steam generator components, and can cause denting in other materials due to its growth. Other maintenance issues besides sludge buildup can arise, such as degradation of some of tubes 106 (either related to the sludge buildup or due to some other cause), failure modes of other components such as steam separators, etc.

Accordingly, steam generator 102 is sometimes shut down for maintenance. A shutdown may be performed in response to a specific detected problem, or on a pre-determined schedule (such as when the nuclear reactor is shut down for maintenance). During a steam generator maintenance shutdown, coolant flow to tubes 106 and vessel 104 is terminated and vessel 104 is drained. Various maintenance operations are typically performed such as tube inspection, plugging of any tubes found to be defective (so as to remove the plugged tubes from service), inspection of ancillary components such as cyclonic steam dryers, and so forth. One common maintenance operation is sludge removal.

Known approaches for sludge removal include chemical cleaning and lancing using a high-pressure water beam. Lancing using a 10 kpsi water beam or a 3 kpsi water beam are two conventional approaches. With particular reference to FIG. 2, a conventional sludge lancing approach for honeycomb patterned tubes 106 orients the water beam at 90° respective to the direction of no tube lane 112. This orientation is suitably determined visually, by rotating the water ejection nozzle until a strong beam is observed exiting from the tube bundle. Then, the beam is locked into this angle and the corresponding lancing head is moved along no tube lane 112 to lance the various 90° tube lanes. FIG. 2 shows the 90° beams $B_{90}$ passing along the 90° tube lanes to remove sludge from the space between tubes 106. However, as illustrated in FIG. 2, this approach can leave large, typically hourglass-shaped, sludge remnants 101.

Figure 3:
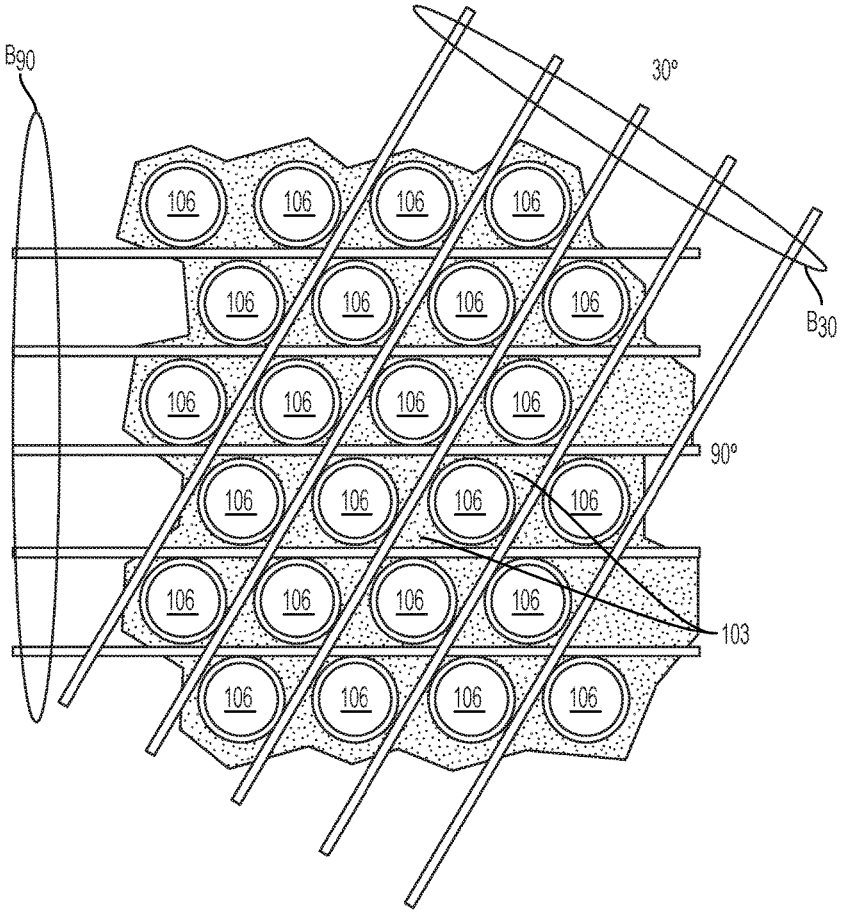
FIG. 3 diagrammatically shows sludge lancing suitably performed by the sludge lancing system shown in FIG. 1 along tube lanes at 90° respective to the no tube lane and at 30° respective to the no tube lane.

Referring now to FIG. 3, it is recognized herein that performing sludge lancing along two tube lane angles, namely the 90° and 30°, provides improvement in terms of reduced remnants. The lancing shown in FIG. 3 differs from that shown in FIG. 2 in that additional lancing is performed with successive 30° beams $B_{30}$ along with the 90° beams $B_{90}$. This leaves smaller, typically triangular or trapezoidal sludge remnants 103, as shown.

Figure 4:
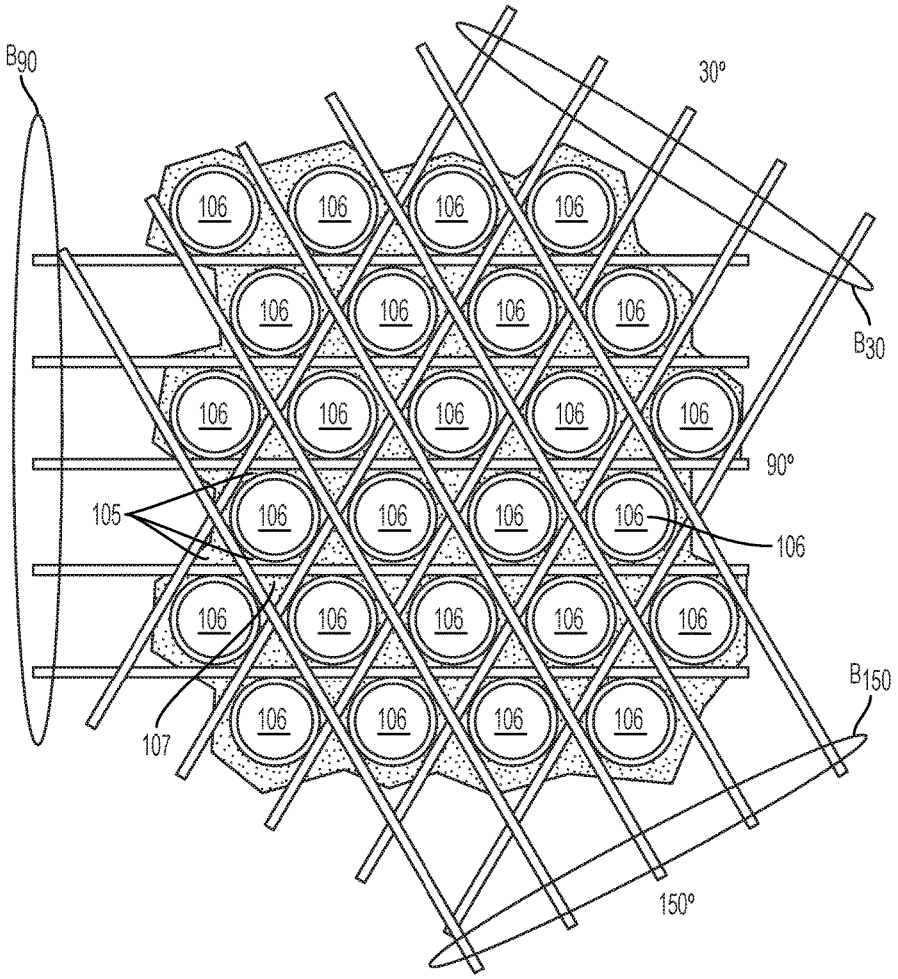
FIG. 4 diagrammatically shows sludge lancing suitably performed by the sludge lancing system shown in FIG. 1 along tube lanes at 90° respective to the no tube lane and at 30° respective to the no tube lane and at 150° respective to the no tube lane.

Referring now to FIG. 4, it is further recognized herein that performing sludge lancing along three tube lane angles, namely the 90°, 30°, and 150° tube lanes, provides substantial improvement in terms of reduced remnants. This approach uses lancing performed using 30° beams $B_{30}$, 90° beams $B_{90}$, and 150° beams $B_{150}$. This approach leaves only minor remnants 105. Note that disengaged sludge portions 107 are fully disengaged from the surrounding tubes 106 and hence are not likely to remain as remnants.

Figure 5:
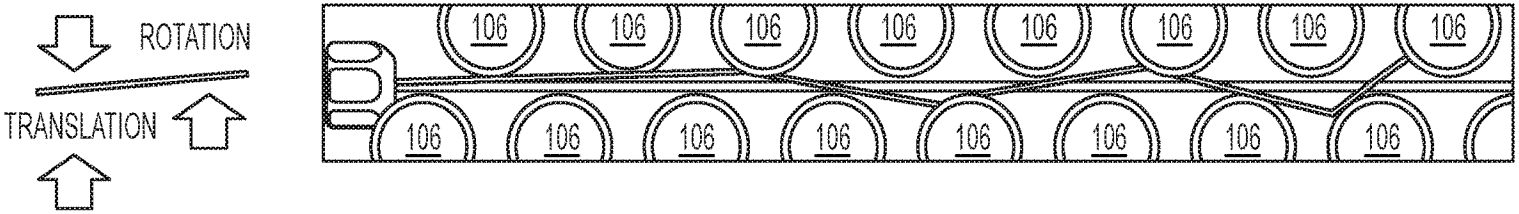
FIG. 5 diagrammatically shows the effect of a misalignment of the lancing water jet respective to the tube lane being lanced.
Figure 6:
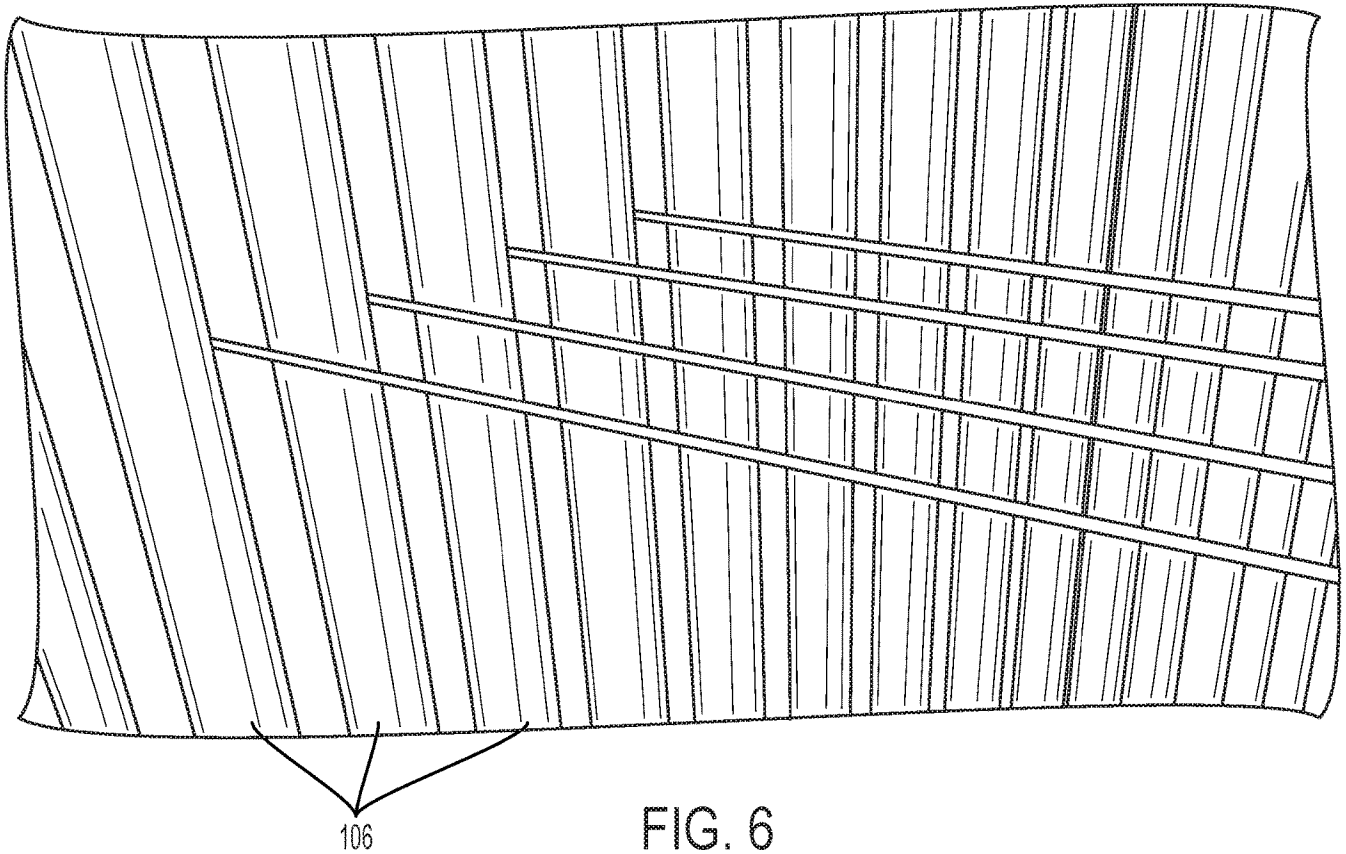
FIG. 6 shows compact exit water jets in a case in which the water jets are precisely aligned with the tube lane being lanced.
Figure 7:
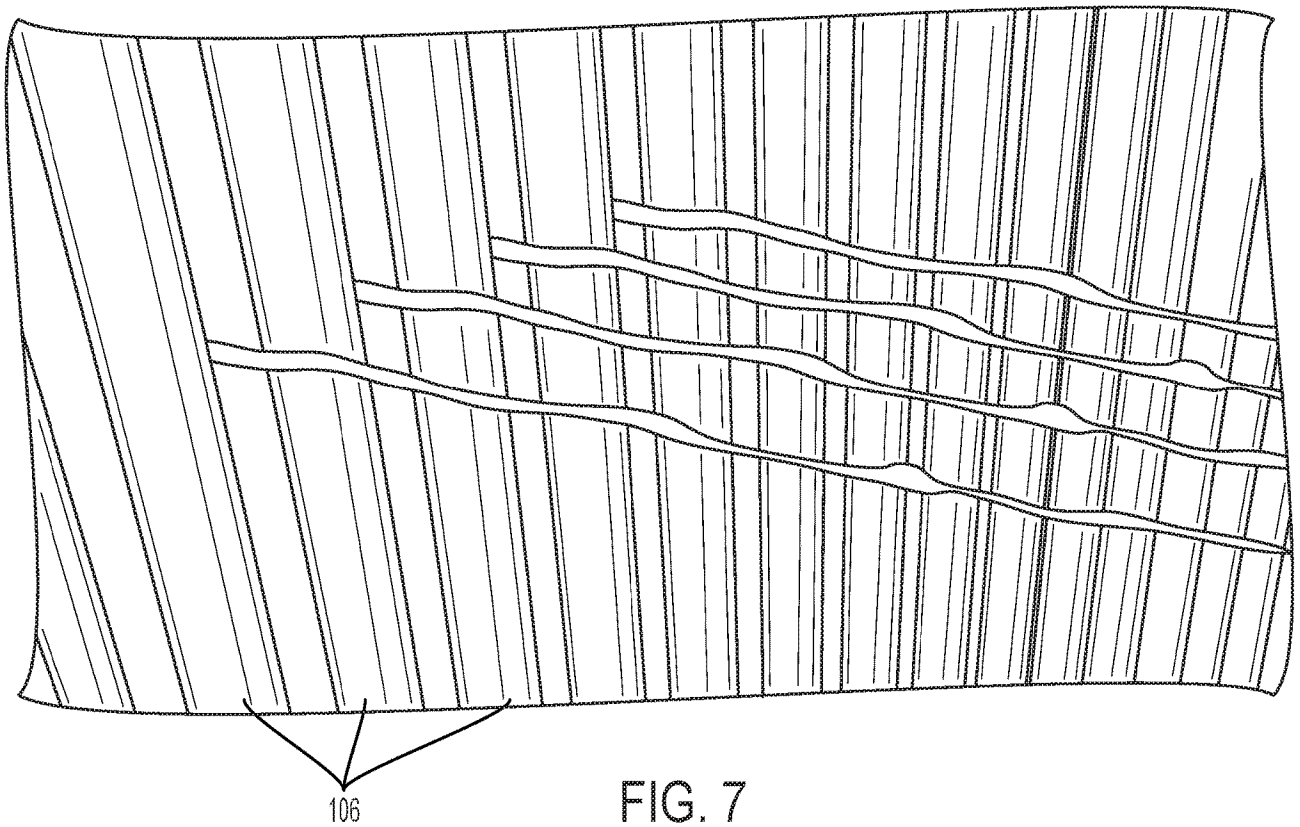
FIG. 7 shows diffuse exit water jets in a case in which the water jets are misaligned with the tube lane being lanced.
Figure 8:
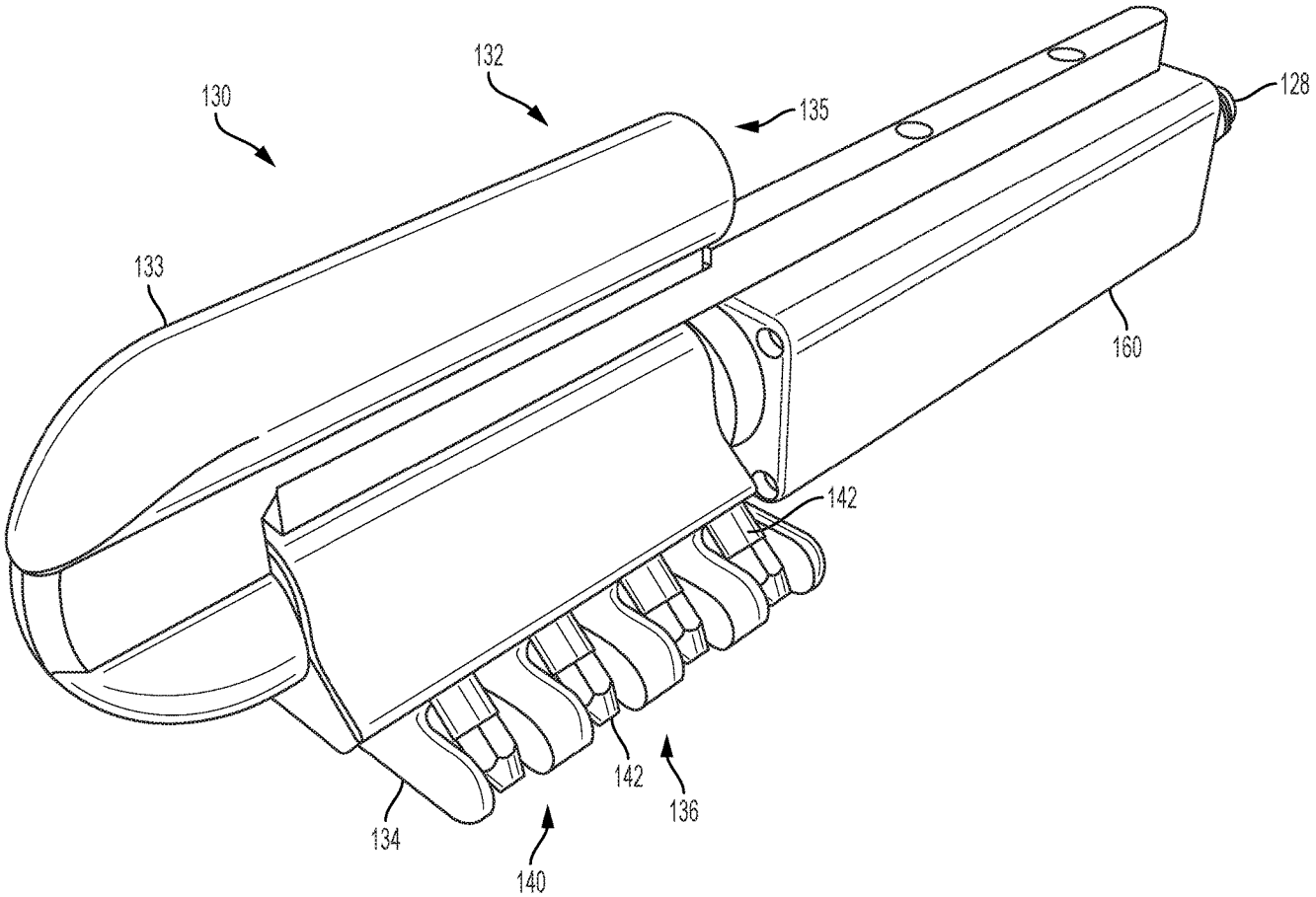
FIG. 8 is a perspective view of a lancing head of the sludge lancing system shown in FIG. 1, in accordance with a first embodiment of the present disclosure.

With reference to FIGS. 5 through 7, sludge lancing effectiveness depends strongly on precise alignment of the lancing water beam with the tube lane. As indicated in the diagram at the left side of FIG. 5, angular misalignment can significantly degrade the sludge removal force of the water spray beams. The right side of FIG. 5 diagrammatically shows how angular misalignment can lead to a ricocheting of the beam that reduces its sludge-removing force. FIGS. 6 and 7 illustrate that beam alignment can be observed visually. As seen in FIG. 6, precise beam alignment leads to a narrow beam exiting from the bundle of tubes 106. By contrast, as seen in FIG. 7 beam misalignment causes the beam exiting from the bundle of tubes 106 to be diffuse and scattered.

The illustrative embodiment employs the illustrative honeycomb or hexagonal tube pattern having tube lanes at 30°, 90°, and 150° angles respective to the reference 0° of no tube lane 112, and lancing at two angles (illustrative 90° and 30° as per FIG. 3) or all three available angles (90°, 30°, and 150° as per FIG. 4) provides improved sludge removal. More generally, lancing at two or more different angles is advantageous. Depending on the tube pattern (triangular, square, etc.), these different angles may be other than the illustrative 30°, 90°, and 150° tube lane angles of the honeycomb pattern. Typically, the different angles will be at least 45° apart, such as with the triangular and rotated square tube geometries, and in the illustrative embodiment the different angles are at least 60° apart (i.e. the 30° and 90° different angles differ by a 60° interval, the 90° and 150° different angles differ by a 60° interval, and the 30° and 150° different angles differ by a 120° interval).

Figure 17:
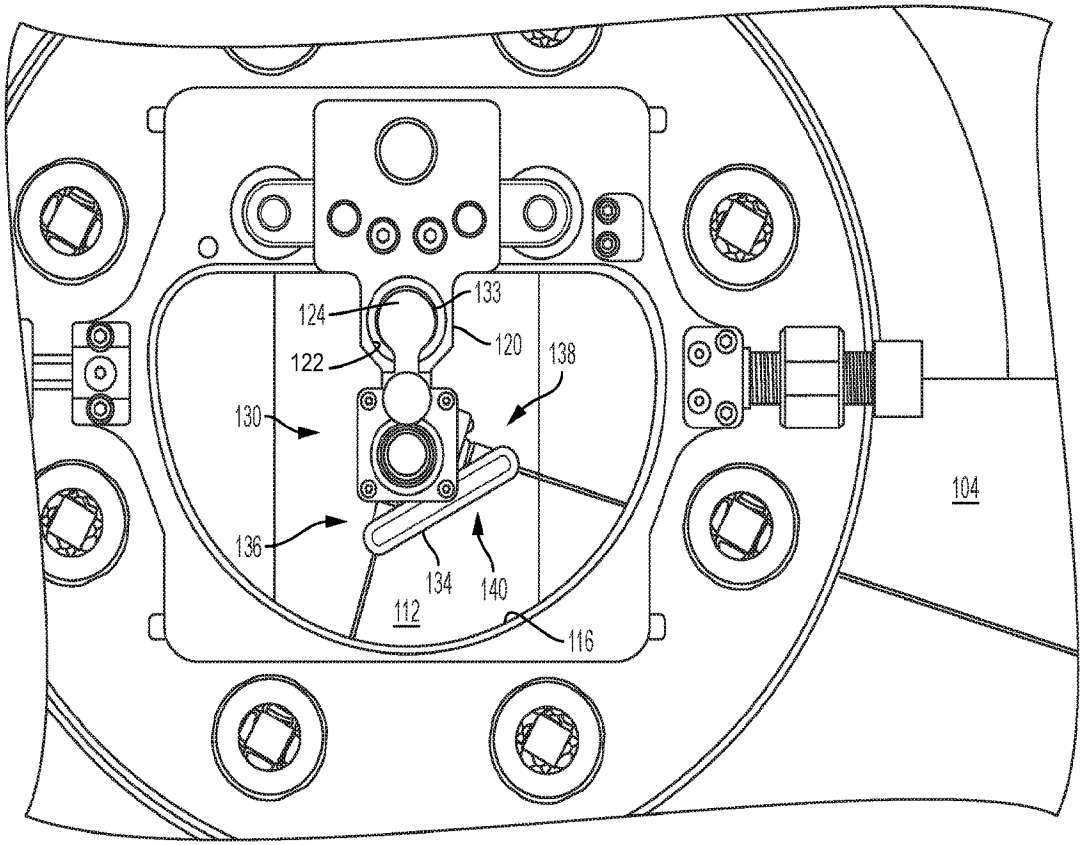
FIG. 17 is an end view of the lancing head, shown in FIGS. 8 through 12, mounted to a corresponding rail.

Referring now to FIGS. 8 through 12, a first lancing head 130 of the disclosed sludge lancing system 100 is shown which provides for lancing along the 90° tube lanes (FIG. 2). Preferably, first lancing head 130 includes a body 132, a nozzle assembly 140 pivotably mounted thereto, and a housing 160 in which a motor (not shown) for rotating nozzle assembly 140 is disposed. Referring additionally to FIG. 17, during lancing operations, first lancing head 130 is configured to be both supported by, and slidably moved along, an elongated rail 120 of the system. As previously noted, when in use rail 120 is mounted inside a vessel 104 of a steam generator 102 so that it extends along the generator's no tube lane 112, as shown in FIG. 1. When positioned for lancing operations, a longitudinal center axis 124 of an elongated groove 122 that is defined along the length of rail 120 is parallel to floor 114 (horizontal reference plane) of the steam generator. Body 132 of first lancing head 130 includes a head portion 133 that is slidably received in elongated groove 122 to support first lancing head 130 on rail 120. Specifically, as best seen in FIG. 17, the cross-sectional shapes of elongated groove 122 and head portion 133 are the same when taken in a vertical plane that is transverse to longitudinal center axis 124 of the rail's groove 122. As shown, the cross-sectional shapes are circular, but other cross-sectional shapes may be used in alternate embodiments. Body 132 also includes a fluid inlet 135 for attachment of a high pressure fluid hose (not shown) to a "U"-shaped conduit 126 defined with body 133 of the lancing head. Preferably, as discussed in greater detail below, the high pressure water hose is used to move first lancing head 130 along rail 120 is sized such that it is retained within groove 122 during lancing operations.

Figure 11:
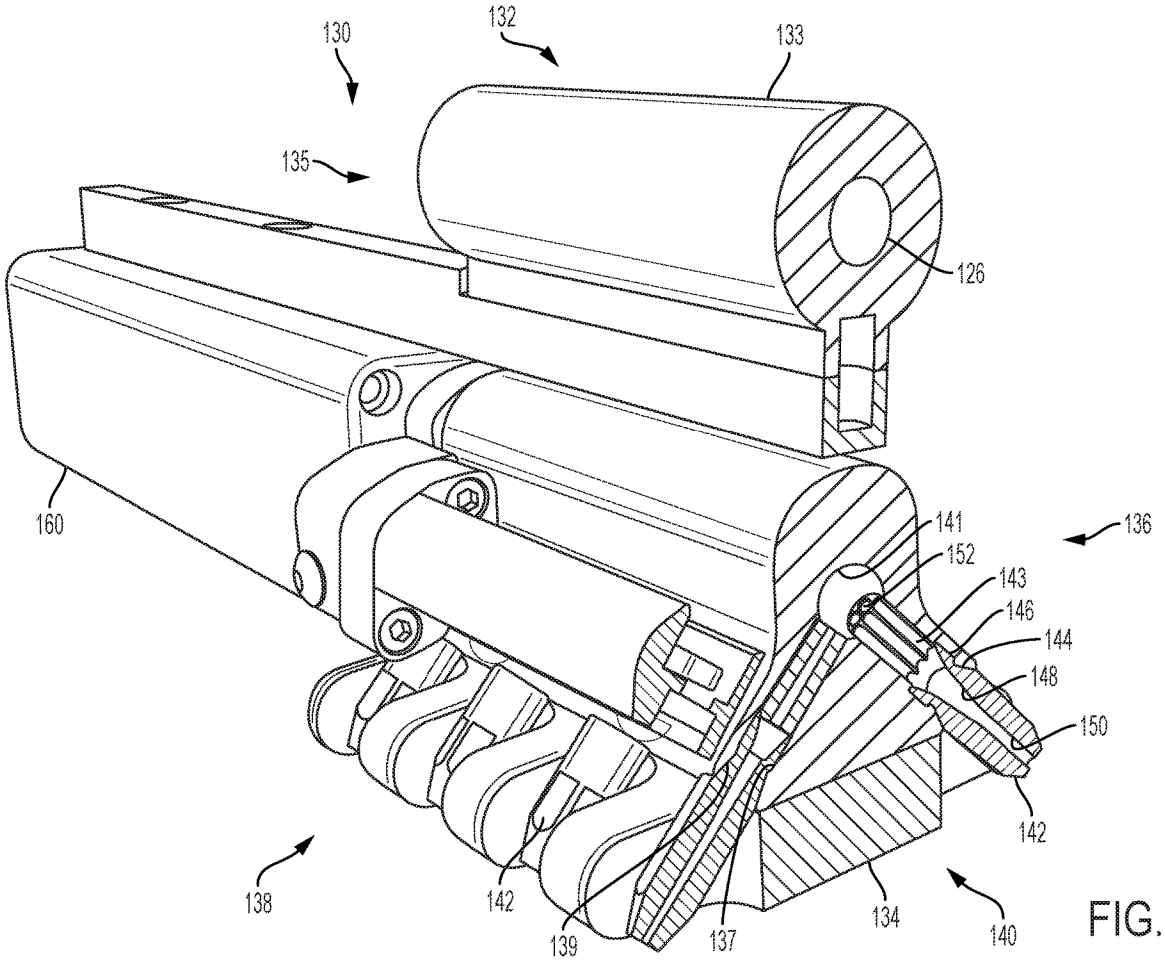
FIG. 11 is a cross-sectional view of the lancing head shown in FIGS. 8 through 10, taken along lines 11-11 of FIG. 9.
Figure 12:
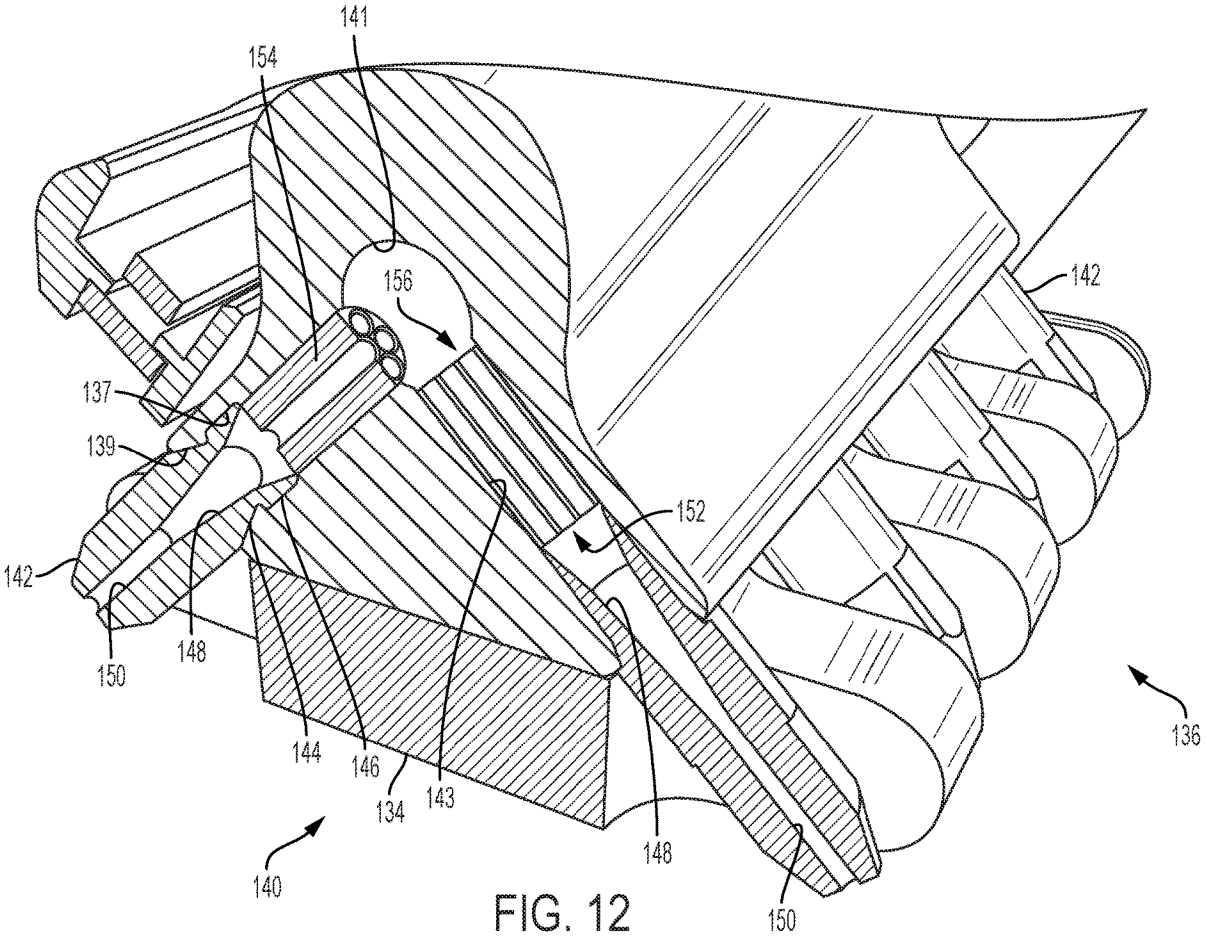
FIG. 12 is an enlarged view of a portion of FIG. 11, showing that the conduit of the first nozzle lies in a first plane that is transverse to the longitudinal center axis of the rail so that the lancing fluid jet of the first nozzle is disposed in the first plane when the manifold is pivoted about the axis of rotation.

As best seen in FIGS. 11 and 12, nozzle assembly 140 of first lancing head 130 includes a pivotable nozzle manifold 134, and a first bank of nozzles 136 and a second bank of nozzles 138 disposed on opposite sides thereof. Preferably, each of first and second banks of nozzles 136 and 138 includes a plurality of nozzles 142, each of which is removably secured to nozzle manifold 134. Each nozzle 142 preferably includes a frustoconical seat 144 and a threaded base 146 or its proximal end. Each frustoconical seat 144 is configured to be matingly received in a corresponding frustoconical recess 139 defined in nozzle manifold 134 as threaded base 146 of each nozzle 142 is rotatably received in a corresponding threaded recess 137 of the nozzle manifold. Frustoconical seats 144 and recesses 139 are configured to facilitate proper alignment of nozzles 142 and, therefore, the lancing fluid jets during lancing operations. As shown, each nozzle 142 of nozzle assembly 140 is configured to produce a lancing fluid jet that radiates outwardly from first lancing head 130 at a 90° angle with respect to longitudinal center axis 124 of the elongated rail. Note, as best seen in FIG. 17, first and second banks of nozzles 136 and 138 are configured to produce corresponding fluid lancing jets that form an acute angle therebetween. In the embodiment shown, the angle formed between the fluid lancing jets of the two of the respective banks is 45°, although in other embodiments the angle may differ.

As shown in FIGS. 11 and 12, nozzle manifold 134 defines a main conduit 141 that extends axially along its length. Main conduit 141 of nozzle manifold 134 is in fluid communication with U-shaped conduit 126 of body 132. Conduit 126 is shown in dotted reference lines in FIG. 9. Additionally, nozzle manifold 134 defines a plurality of cylindrical bores 143 that extend radially-outwardly from its main conduit 141. Each bore 143 is configured to receive a flow straightener 152 therein for each corresponding nozzle 142. Each flow straightener 152 includes a cylindrical body 154 and a plurality of longitudinal conduits extending between its end faces. One end face is disposed adjacent main conduit 141 whereas the other end face is disposed adjacent a threaded base 146 of a corresponding nozzle 142. Further, each nozzle 142 includes a conduit extending along its longitudinal center axis that is defined by a frustoconical portion 148 that is adjacent a corresponding flow straightener 152 and a cylindrical portion 150 that extends from frustoconical portion 148 to a distal end of the nozzle. Each flow straightener 152 is configured to enhance laminar flow within the fluid that is provided to the corresponding nozzle 142. Enhancing the laminar flow entering each nozzle 142 improves the performance of the nozzle, as compared to known lancing systems, in that the laminar flow improves the ability of each nozzle to produce a more cohesive fluid lancing jet.

Figure 9:
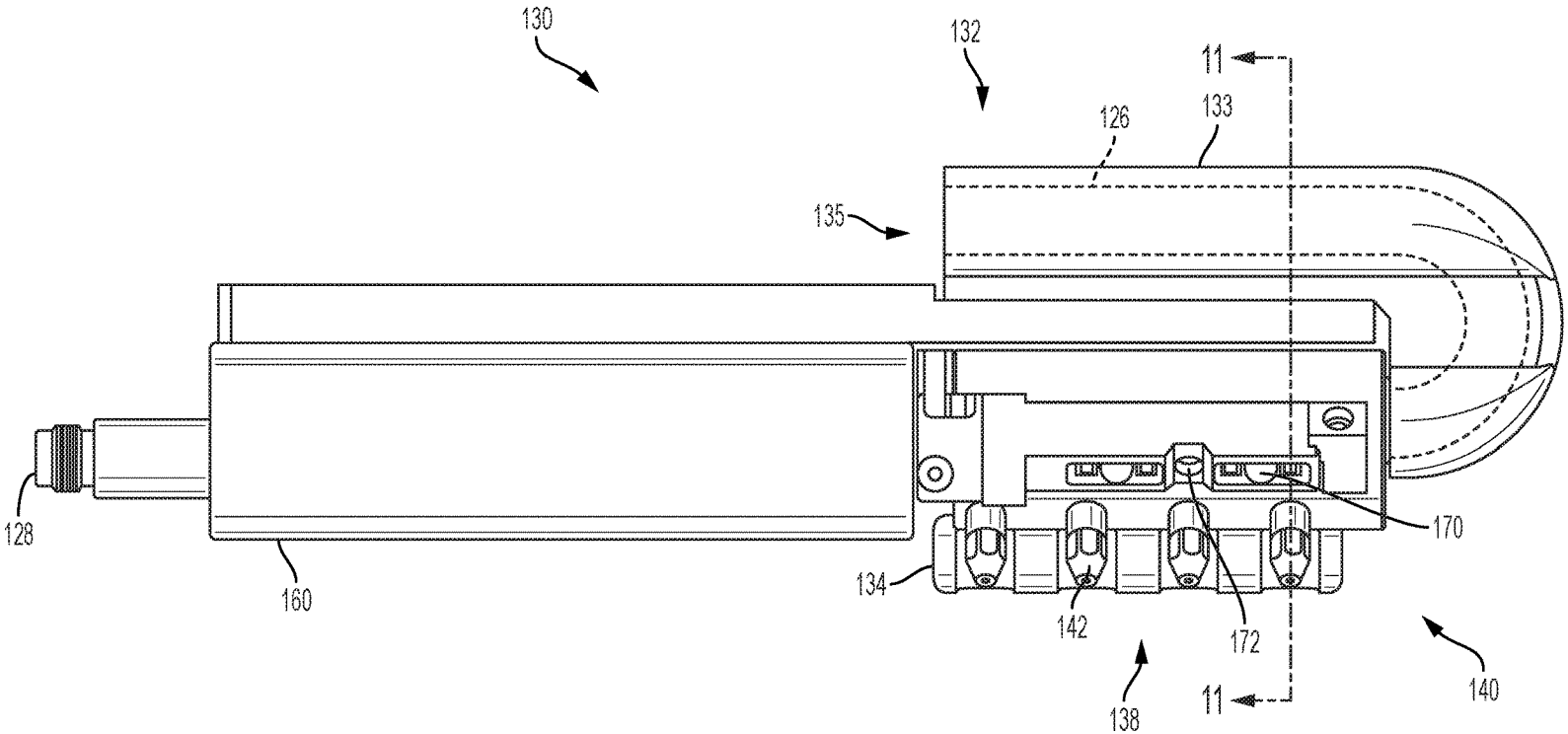
FIG. 9 is a side view of the lancing head shown in FIG. 8.
Figure 10:
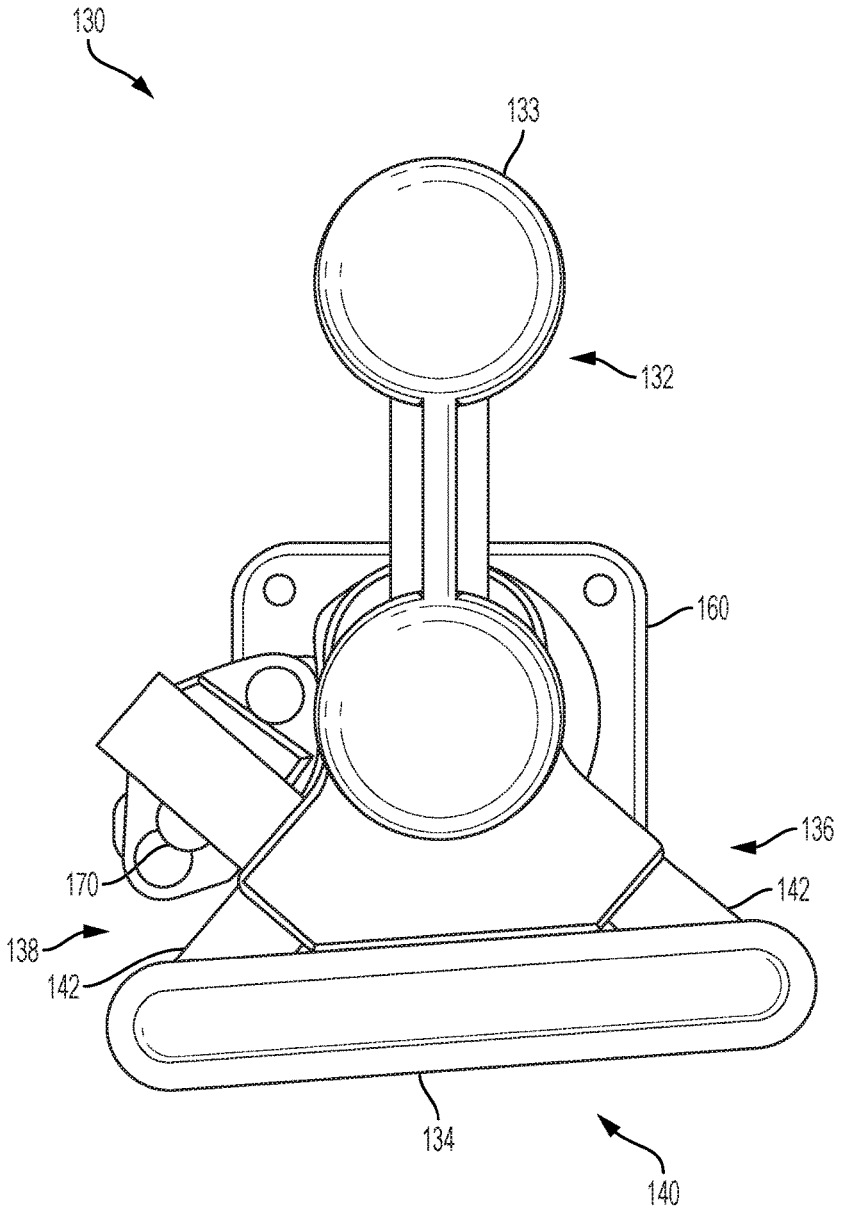
FIG. 10 is a front view of the lancing head shown in FIG. 8.

As best seen in FIG. 9, first lancing head 130 preferably includes an on-board inspection camera 172 and one or more light emitting diodes 170. As shown, camera 172 and light emitting diodes 170 are mounted on one side of nozzle manifold 134 adjacent a bank of nozzles, in this case first bank of nozzles 136. As such, camera 172 and light emitting diodes 170 move with the nozzles as nozzle manifold 134 is pivoted about its longitudinal center axis during lancing operations. Light emitting diodes 170 provide illumination by which an operator can view the tube lanes of the corresponding steam generator before, during, and/or after lancing operations. As such, inspection camera 172 may be utilized to determine the state of sludge build-up prior to lancing, align first lancing head 130 with the desired tube lanes prior to lancing, and determine the effectiveness of sludge removal both during and after the lancing operations. In alternate embodiments, a laser alignment system utilizing an alignment laser diode (not shown) may also be provided. In such an embodiment, the laser diode is mounted to nozzle manifold 134 so that the laser being generated by the laser diode is pre-aligned parallel with a lancing fluid jet of one of the plurality of nozzles 142. As such, the laser beam serves as an optical sight for the lancing fluid jet and is visible to camera 172 for alignment of the lancing head prior to operations. Note, in alternate embodiments, an inspection camera 172 and light emitting diodes 170 may be provided on both sides of nozzle manifold 134.

Figure 13:
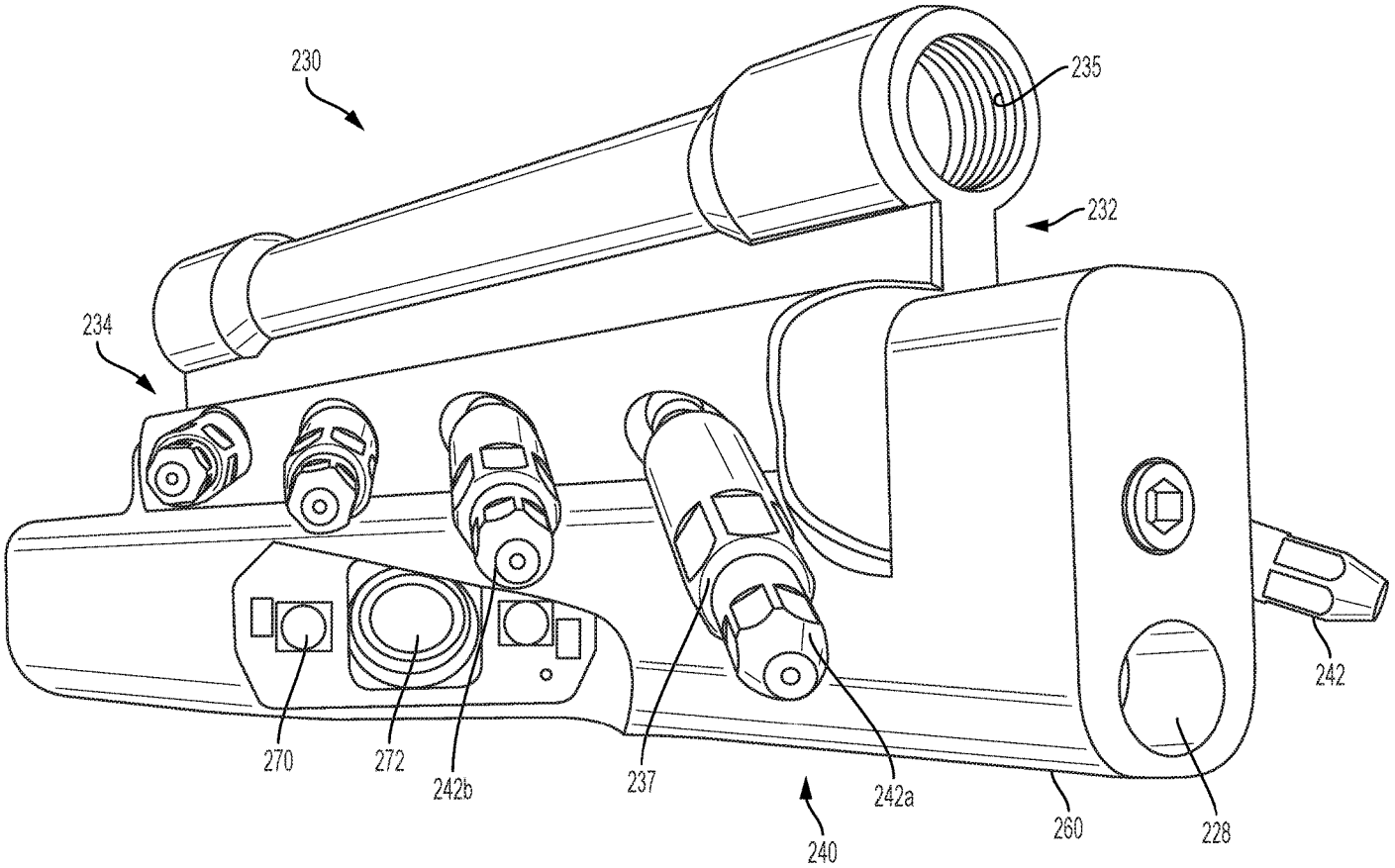
FIG. 13 is a perspective view of a second embodiment of a lancing head in accordance with the present disclosure.
Figure 14:
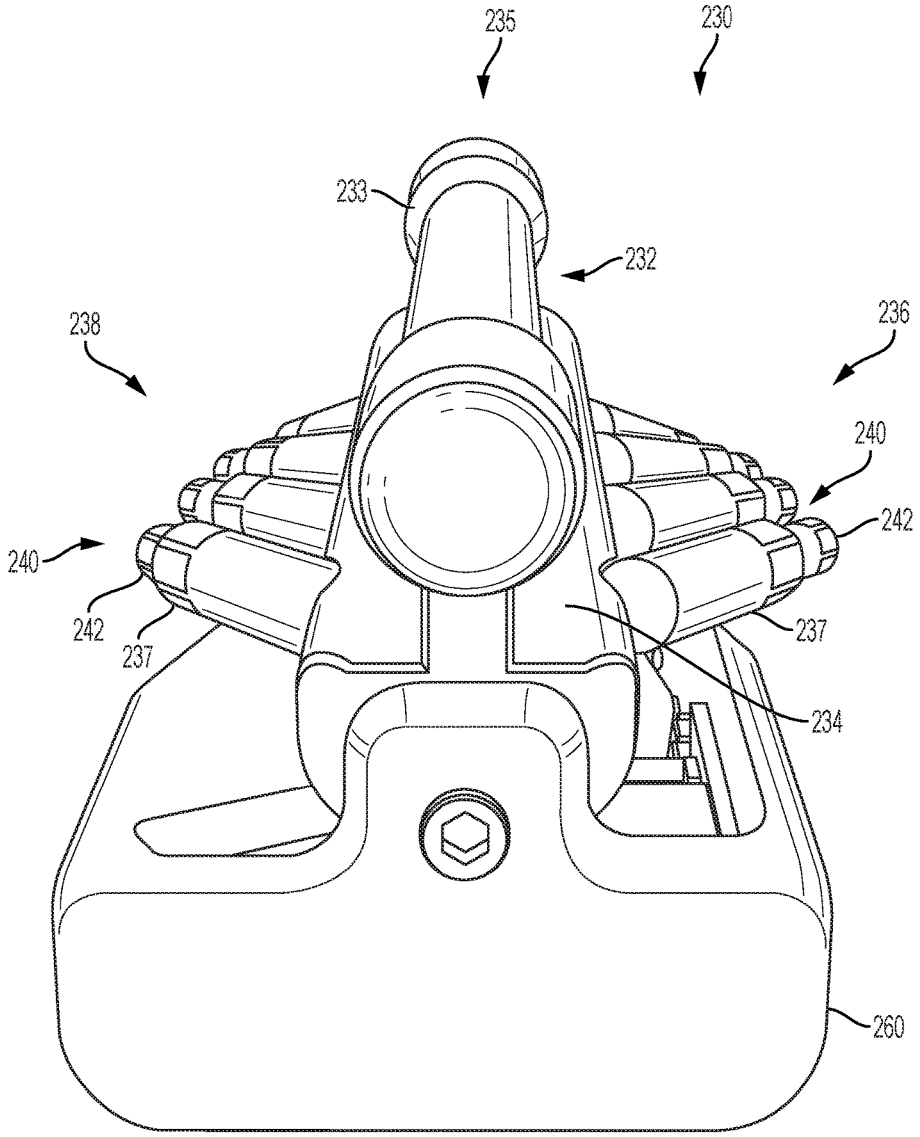
FIG. 14 is a front perspective view of the lancing head shown in FIG. 13.
Figure 15:
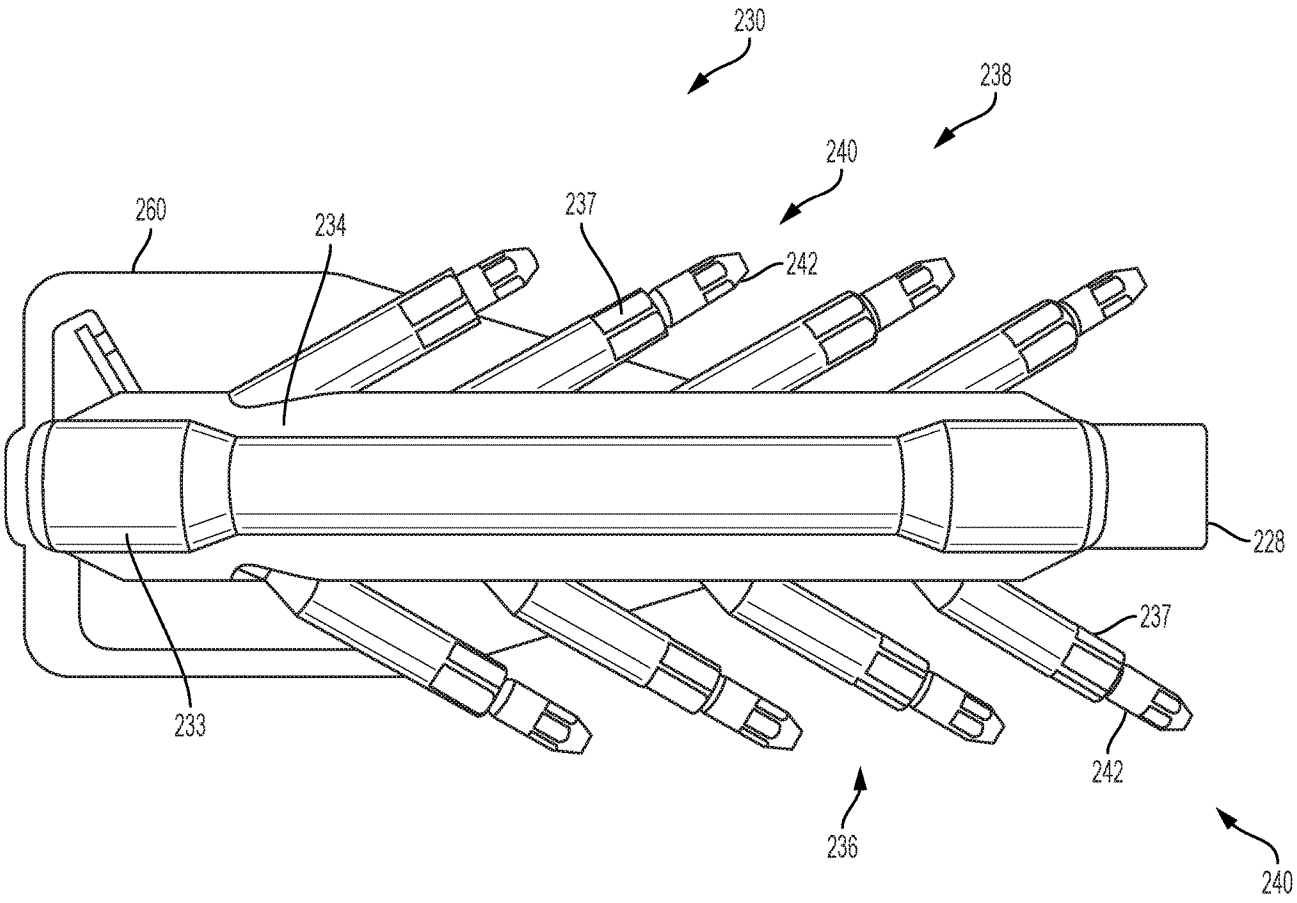
FIG. 15 is a top view of the lancing head shown in FIG. 13.

Referring now to FIGS. 13 through 15, a second lancing head 230 of the disclosed sludge lancing system 100 is shown. Whereas first lancing head 130 allows for lancing along the 90° tube lanes (FIG. 2), second lancing head 230 allows for lancing along both the 30° and 150° tube lanes (FIGS. 3 and 4). Preferably, second lancing head 230 includes a body 232 having a nozzle manifold 234, a first nozzle bank 236, a second nozzle bank 238, and a housing 260 in which electronics are enclosed. Referring additionally to FIG. 17, during lancing operations, second lancing head 230 is configured to be both supported by, and slidably moved along, elongated rail 120 of the system in a manner similar to that of first lancing head 130. As previously noted, when positioned for lancing operations, longitudinal center axis 124 of elongated groove 122 is parallel to floor 114 (horizontal reference plane) of the steam generator. In addition to nozzle manifold 234, body 232 of second lancing head 230 includes a head portion 233 that is slidably received in elongated groove 122 to support second lancing head 230 on rail 120. Similarly to first lancing head 130, the cross-sectional shape of head portion 233 is circular, but other cross-sectional shapes may be used in alternate embodiments. Body 232 also includes a fluid inlet 235 for attachment of the high pressure fluid hose to a "U"-shaped conduit (not shown) defined within body 232 of the lancing head. As described before, the high pressure water hose is used to move second lancing head 230 along rail 120 during lancing operations.

As shown, first bank of nozzles 236 and a second bank of nozzles 238 are disposed on opposite sides of nozzle manifold 234. Preferably, each of first and second banks of nozzles 236 and 238 includes a plurality of nozzles 242, each of which is removably secured to nozzle manifold 234 by way of a corresponding nozzle housing 237. Each nozzle 242 of second lancing head 230 is similar to the previously discussed nozzles 142 (FIGS. 11 and 12), so that discussion is not repeated here. Note, however, each frustoconical recess 139 (FIG. 12) and corresponding threaded recess 137 (FIG. 12) for receiving a nozzle 242 are now defined with a corresponding nozzle housing 237 rather than directly in the nozzle manifold. Similarly, each nozzle housing 237 also include a cylindrical bore for receiving one of the previously discussed flow straighteners 152 (FIG. 12).

Figure 16:
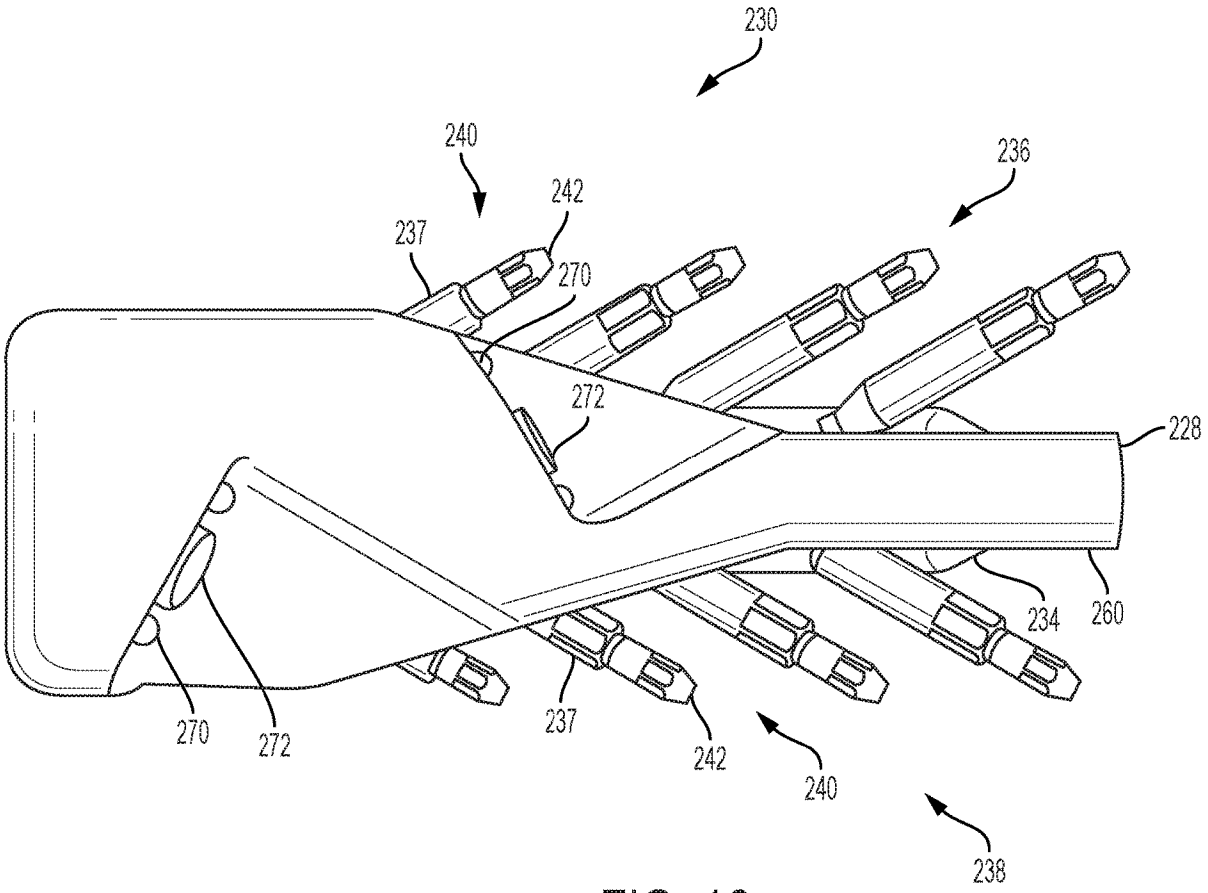
FIG. 16 is a bottom view of the lancing head shown in FIG. 13.

As shown, each nozzle 242 of first and second nozzle banks 236 and 238 is configured to produce a lancing fluid jet that radiates outwardly from second lancing head 230 at a 30° angle with respect to longitudinal center axis 124 of the elongated rail. However, as best seen in FIG. 13, each nozzle 242 within each bank of nozzles preferably produces a lancing fluid jet that varies angularly with respect to the lancing jets of the receiving nozzles with reference to a horizontal plane 240 in which a longitudinal center axis of the nozzle manifold 234 lies. For example, as shown in FIG. 13, the angle defined between a fluid lancing jet from nozzle 242*a* and the noted horizontal plane 240 is greater than the angle defined between a fluid lancing jet from nozzle 242*b* and horizontal plane 240. As such, as second lancing head 230 is moved along rail 120, the fluid lancing jet of each subsequent nozzle 242 within a given nozzle bank will impact a different portion of the sludge disposed within the tube lanes. This feature allows for enhanced sludge removal along the 30° and 150° tube lanes although first and second nozzle banks 236 and 238 are not rotated during lancing operations. Note, also, as best seen in FIG. 16, second lancing head 230 includes a pair of inspection cameras 272, or for each bank of nozzles, and multiple light emitting diodes 270. As shown, each inspection camera 272 is angularly aligned with nozzles 242 of its corresponding bank of nozzles.

Referring now to FIGS. 1 and 17, a sludge lancing operation utilizing the previously disclosed sludge lancing system 100 is discussed. First, vessel 104 of steam generator 102 is accessed by way of manways 116 so that elongated rail 120 can be positioned along the steam generator's no tube lane 112. As previously noted, rail 120 is mounted to vessel 104 such that its longitudinal center axis 124 is parallel to floor 114, or the horizontal reference plane, of the steam generator. Once a high pressure fluid hose (not shown) and a power cable (not shown) are connected to first lancing head 130 (FIG. 8) by way of fluid inlet 135 and threaded stem 128, respectively, head portion 133 of first lancing head 130 is slidably disposed within elongated groove 122 of rail 120, as shown in FIG. 17. Preferably, the fluid hose is used to urge first lancing head 130 along rail 120 to its opposite end. Once first lancing head 130 is positioned at the distal end of rail 120, the operator utilizes light emitting diodes 170 and inspection camera 172 to properly align the fluid lancing jets produced by first and second banks of nozzles 136 and 138 with the 90° tube lanes, as shown in FIG. 2. Specifically, inspection camera 172 allows an operator to observe the alignment of the fluid lancing jets in real time. Preferably, first lancing head 130 remains in the first lancing position on rail 120 for approximately three to four minutes as nozzle manifold 134 pivots the fluid lancing jets of the nozzle banks through a desirable degree range. The fluid lancing jets remain within vertical planes that are transverse to longitudinal center axis 124 of rail 120.

After lancing is complete in the first position, first lancing head 130 is moved incrementally the distance between adjacent parallel 90° tube lanes, and a second interval of the lancing operation is performed in the second position. This incremental movement of first lancing head 130 is continued until first lancing head 130 has been moved the length of rail 120 and is positioned at the rail's proximal end, as shown in FIG. 17. First lancing head 130 is now removed from rail 120 so that second lancing head 230 may be disposed thereon.

After second lancing head 230 (FIG. 13) is connected to the high pressure fluid hose and the power cable, second landing head 230 is positioned on rail 120 with its head portion 233 being disposed in elongated groove 122. As with first lancing head 130, second lancing head 230 is urged along rail 120 by the fluid hose until it reaches the distal end of the rail. Once second lancing head 230 is in position, light emitting diodes 270 and inspection cameras 272 are used to align the fluid lancing jets produced by first and second banks of nozzles 236 and 238 with the 30° tube lanes within the steam generator, as shown in FIG. 3. When aligned, a first interval of fluid lancing is performed for a pre-selected amount of time, which is variable and determined based on the requirements of the sludge lacing plan. Upon completion of the first lancing interval, second lancing head 230 is moved incrementally along rail 120 a distance corresponding to the distance between adjacent, parallel 30° tube lanes. When positioned, a second interval of fluid lancing is performed in the second position. Note, the intervals of fluid lancing need not be identical for each position of the lancing head. For example, increased time intervals may be desired at positions where sludge concentrations are expected to be the highest, such as in the middle region of the tubsheet. This process is continued until second lancing head 230 has been moved incrementally along the entire length of rail 120.

Next, the operator positions second lancing head 230 on the opposite end of rail 120 by way of the opposite manway 116. The same process discussed above for second lancing head 230 is repeated, but from the opposite end of rail 120. As such, second lancing head 230 can be used to lance both the 30° tube lanes and 150° tube lanes, as shown in FIG. 4.

While one or more preferred embodiments of the present invention have been described above, it should be understood that any and all equivalent realizations of the present invention are included within the scope and spirit thereof. Thus, the depicted embodiment(s) are presented by way of example only and are not intended as limitations on the present invention. It should be understood that aspects of the various one or more embodiments may be interchanged both in whole or in part. Therefore, it is contemplated that any and all such embodiments are included in the present invention as may fall within the literal or equivalent scope of the appended claims.

What is claimed is:

1. A sludge lancing system for use in a steam generator including a no tube lane disposed between a first bank of tubes and a second bank of tubes that are transverse to a horizontal reference plane, comprising:

a rail that extends through the no tube lane and includes a longitudinal center axis that is parallel to the reference plane; and a first lancing head, comprising:

a body defining a conduit;

a nozzle assembly that is mounted to the body and is pivotable with respect to the body about an axis of rotation, the nozzle assembly including a manifold defining a conduit that is in fluid communication with the conduit of the body, a first nozzle that is mounted to the manifold and defines a conduit that generates a lancing fluid jet; and a second nozzle that is mounted to the manifold and defines a conduit that generates a lancing fluid jet, the first nozzle and the second nozzle defining an acute angle therebetween, wherein a longitudinal center axis of the conduit of the first nozzle and a longitudinal center axis of the second nozzle lie in a first vertical plane that is transverse to the longitudinal center axis of the rail so that the lancing fluid jets of the first nozzle and the second nozzle are disposed in the first vertical plane when the manifold is pivoted about the axis of rotation.

2. The sludge lancing system of claim 1, further comprising:

a third nozzle that is mounted to the manifold and defines a conduit that generates a lancing fluid jet;

a fourth nozzle that is mounted to the manifold and defines a conduit that generates a lancing fluid jet, wherein a longitudinal center axis of the conduit of the third nozzle and a longitudinal center axis of the conduit of the fourth nozzle lie in a second vertical plane that is both transverse to the longitudinal center axis of the rail and parallel to the first vertical plane so that that the lancing fluid jets of the third nozzle and the fourth nozzle are disposed in the second vertical plane when the manifold is pivoted about the axis of rotation.

3. The sludge lancing system of claim 1, further comprising:

a housing secured to the body portion; and a motor that is disposed within the housing and operably connected to the manifold so that the motor pivots the manifold about the axis of rotation.

4. The sludge lancing system of claim 3, further comprising a shaft that connects the motor to the manifold.

5. The sludge lancing system of claim 1, wherein:

the rail defines an elongated slot that is parallel to its longitudinal center axis; and the first lancing head includes a head portion that is slidably received in the elongated slot.

6. The sludge lancing system of claim 5, wherein a cross-sectional shape defined by the elongated slot in the first vertical plane is the same as a cross-sectional shape of the head portion in the first vertical plane.

7. A sludge lancing system for use in a steam generator including a no tube lane disposed between a first bank of tubes and a second bank of tubes that are transverse to a horizontal reference plane, comprising:

a rail that extends through the no tube lane and includes a longitudinal center axis that is parallel to the reference plane; and a first lancing head, comprising:

a body defining a conduit;

a nozzle assembly that is mounted to the body and is pivotable with respect to the body about an axis of rotation, the nozzle assembly including a manifold defining a conduit that is in fluid communication with the conduit of the body, at least a first nozzle that is mounted to the manifold and defines a conduit that generates a lancing fluid jet;

a first bore defined by the manifold, the first bore being in fluid communication with both the conduit of the manifold and the conduit of the first nozzle, the first bore extending radially outwardly from the conduit of the manifold; and a flow straightener disposed in the first bore, the flow straightener including a first end, a second end, and at least one flow conduit extending therebetween, wherein a longitudinal center axis of the conduit of the first nozzle lies in a first vertical plane that is transverse to the longitudinal center axis of the rail so that the lancing fluid jet of the first nozzle is disposed in the first vertical plane when the manifold is pivoted about the axis of rotation.

8. The sludge lancing system of claim 7, wherein the at least one flow conduit further comprises a plurality of parallel flow conduits.

9. The sludge lancing system of claim 8, wherein the flow conduit of the first nozzle includes a frustoconical portion disposed adjacent the flow straightener and a conical portion that extends from the frustoconical portion to a distal end of the first nozzle.

10. A sludge lancing system for use in a steam generator including a no tube lane disposed between a first bank of tubes and a second bank of tubes that are transverse to a horizontal reference plane, comprising:

a rail that extends through the no tube lane and includes a longitudinal center axis that is parallel to the reference plane;

a first lancing head, comprising:

a body defining a conduit; and a nozzle assembly that is mounted to the body and is pivotable with respect to the body about an axis of rotation, the nozzle assembly including a manifold defining a conduit that is in fluid communication with the conduit of the body, and at least a first nozzle that is mounted to the manifold and defines a conduit that generates a lancing fluid jet, wherein a longitudinal center axis of the conduit of the first nozzle lies in a first vertical plane that is transverse to the longitudinal center axis of the rail so that the lancing fluid jet of the first nozzle is disposed in the first vertical plane when the manifold is pivoted about the axis of rotation, and a second lancing head, comprising:

a body including a manifold defining a conduit; and a nozzle assembly that is mounted to the manifold of the body, the nozzle assembly including a first nozzle housing that is mounted to the manifold and defines a bore that is in fluid communication with the conduit of the manifold, a first nozzle that is mounted to the first nozzle housing and defines a conduit that generates a lancing fluid jet, a second nozzle housing that is mounted to the manifold and defines a bore that is in fluid communication with the conduit of the manifold, and a second nozzle that is mounted to the second nozzle housing and defines a conduit that generates a lancing fluid jet, wherein a longitudinal center axis of the conduit of the first nozzle lies in a first vertical plane that is transverse to both the horizontal reference plane and a first horizontal plane that is parallel to the horizontal reference plane and contains a longitudinal center axis of the conduit of the manifold, and the longitudinal center axis of the conduit of the first nozzle and an intersection line of the first vertical plane and the first horizontal plane define a first acute angle therebetween, and wherein a longitudinal center axis of the conduit of the second nozzle lies in a second vertical plane that is transverse to both the horizontal reference plane and the first horizontal plane that is parallel to the horizontal reference plane and contains a longitudinal center axis of the conduit of the manifold, and the longitudinal center axis of the conduit of the second nozzle and an intersection line of the second vertical plane and the first horizontal plane define a second acute angle therebetween, wherein the first acute angle is larger than the second acute angle.

11. A sludge lancing system for use in a steam generator including a no tube lane disposed between a first bank of tubes and a second bank of tubes that are transverse to a horizontal reference plane, comprising:

a rail that extends through the no tube lane and includes a longitudinal center axis that is parallel to the reference plane; and a first lancing head, comprising:

a body including a manifold defining a conduit; and a nozzle assembly that is mounted to the manifold of the body, the nozzle assembly including a first nozzle housing that is mounted to the manifold and defines a bore that is in fluid communication with the conduit of the manifold, a first nozzle that is mounted to the first nozzle housing and defines a conduit that generates a lancing fluid jet, a second nozzle housing that is mounted to the manifold and defines a bore that is in fluid communication with the conduit of the manifold, and a second nozzle that is mounted to the second nozzle housing and defines a conduit that generates a lancing fluid jet, wherein a longitudinal center axis of the conduit of the first nozzle lies in a first vertical plane that is transverse to both the horizontal reference plane and a first horizontal plane that is parallel to the horizontal reference plane and contains a longitudinal center axis of the conduit of the manifold, and the longitudinal center axis of the conduit of the first nozzle and an intersection line of the first vertical plane and the first horizontal plane define a first acute angle therebetween, and wherein a longitudinal center axis of the conduit of the second nozzle lies in a second vertical plane that is transverse to both the horizontal reference plane and the first horizontal plane that is parallel to the horizontal reference plane and contains a longitudinal center axis of the conduit of the manifold, and the longitudinal center axis of the conduit of the second nozzle and an intersection line of the second vertical plane and the first vertical plane defines a second acute angle therebetween.

12. The sludge lancing system of claim 11, wherein:

the rail defines an elongated slot that is parallel to its longitudinal center axis; and the first lancing head includes a head portion that is slidably received in the elongated slot.

13. The sludge lancing system of claim 12, wherein a cross-sectional shape defined by the elongated slot in a vertical plane that is both transverse to the horizontal reference plane and the longitudinal center axis of the rail is the same as a cross-sectional shape of the head portion in that same vertical plane.

14. The sludge lancing system of claim 11 further comprising:

a first bore defined by the nozzle housing, the first bore being in fluid communication with both the conduit of the manifold and the conduit of the first nozzle, the first bore extending radially outwardly from the conduit of the manifold; and a flow straightener disposed in the first bore, the flow straightener including a first end, a second end, and at least one flow conduit extending therebetween.

15. The sludge lancing system of claim 14, wherein the at least one flow conduit further comprises a plurality of parallel flow conduits.

16. The sludge lancing system of claim 15, wherein the flow conduit of the first nozzle includes a frustoconical portion disposed adjacent the flow straightener and a conical portion that extends from the frustoconical portion to a distal end of the first nozzle.

* * * * *